US005377742A

United States Patent [19]

Jarry

[11] Patent Number: 5,377,742

[45] Date of Patent: Jan. 3, 1995

[54] PROCESS FOR OBTAINING BIMATERIAL PARTS BY CASTING AN ALLOY AROUND AN INSERT COATED WITH A METAL FILM

[75] Inventor: Philippe Jarry, Grenoble, France

[73] Assignee: Pechiney Recherche, Courbevoie, France

[21] Appl. No.: 26,680

[22] Filed: Mar. 4, 1993

[30] Foreign Application Priority Data

Mar. 4, 1992 [FR] France ..... 92 02798

[51] Int. Cl.[6] ..... B22D 19/02

[52] U.S. Cl. ..... 164/100

[58] Field of Search ..... 164/100

[56] References Cited

FOREIGN PATENT DOCUMENTS 0384045 8/1990 .

0472478 2/1992 .

*Primary Examiner*—Kuang Y. Lin

*Attorney, Agent, or Firm*—Dennison, Meserole, Pollack & Scheiner

[57] ABSTRACT

A process for obtaining bimaterial parts by casting an aluminum alloy onto an insert coated with a metal film. In this process, the oxide layer is removed from the insert by treatment under vacuum, and then the insert is coated with a titanium based film by physical vapor deposition, and the insert is placed in a mold which is filled with a casting alloy.

13 Claims, 3 Drawing Sheets

PROCESS FOR OBTAINING BIMATERIAL PARTS BY CASTING AN ALLOY AROUND AN INSERT COATED WITH A METAL FILM

BACKGROUND OF THE INVENTION

The present invention relates to a process for obtaining bimaterial parts by casting an alloy around insert coated with a metal film.

The invention relates, more particularly, to the parts formed from an insert of aluminum or of another metal such as iron or copper, which is at least partly integrated into an aluminum alloy matrix, during a casting operation.

This particular structure is used, for example, for the manufacture of car parts such as engine cylinder heads, in order to try to locally modify their properties, and for inserting pipes into aeronautical molded parts.

In fact, it is known that such parts are locally subjected to stresses during use, in particular thermal stress, and that to avoid certain effects detrimental to their behavior, inserts having properties which better satisfy the stresses than the base material, are usually embedded in the parts.

However, it has been noted that the manufacture of these bimaterial parts was problematical, particularly in respect of the bond between the insert and the metal cast around it.

In fact, on the one hand, adherence between the constituent parts is not always as it should be, and as a result the mechanical properties or physical properties such as heat conductivity are inadequate; on the other hand, since the casting is made with the metal in the molten state by filling a mold in which the insert has been placed, if the metal forming the insert has a fusion temperature which is less than, or close to, that of the casting metal, the insert becomes deformed, and this is detrimental to correct localization thereof.

DESCRIPTION OF RELATED ART

It is true that solutions have already been provided to this problem. By way of example, European Patent Application 384 045 may be cited which teaches a process for obtaining a metallurgical bond between a metal material (or a composite material with a metal matrix), and a casting metal (or casting metal alloy) process which comprises a step of performing a surface treatment on the material by means of the deposition of a thin layer of metal, usually different from the metals contained in the material and the casting metal, and which is capable of increasing wettability and also the heat transfer between the casting metal and the material, and a step of casting around the material of the same metal, placed inside a mold, of the casting metal or metal alloy.

In the cited application, the fine layer which makes it possible for the metallurgical bond to be produced is composed of a metal belonging to the group formed by gold, silver, copper, nickel, platinum, chromium, tungsten, iridium, molybdenum, tantalum, niobium, osmium, rhenium, rhodium, ruthenium and zirconium.

According to this European patent, the thin layers of metals are able to provide wettability to the insert in order to allow heat transfer to this insert. It is specified that the oxide layer on the surface of the insert must be washed by the liquid molding metal. To solve the problem of connecting the insert to the casting metal, Applicant has proposed a solution in French Patent Application No. 90 10224, corresponding to U.S. Pat. No. 5,259,437. According to this patent, a natural surface coating of alumina is removed from the insert by acid or basic washing, and the insert is coated immediately with a metal film impermeable to gases, having a free oxide-forming energy in excess of −500 kJ/mole of oxygen between room temperature and 1000 K, having a melting temperature greater than that of the insert and the matrix into which it is inserted, and being soluble in aluminum and forming a eutectic with aluminum. The insert is placed in a mold which is filled with the casting metal at a temperature such that at least 30% of the insert is remelted.

Although these solutions effectively improve the metallurgical bond between the insert and the casting metal by reducing or removing the layer of aluminum oxide at the surface of the insert, the solutions do not take into consideration the oxide present at the surface of the liquid casting metal which forms quite a considerable obstacle to a perfect bond between the materials present.

SUMMARY OF THE INVENTION

For this reason, Applicant, in an attempt to solve the oxide problem, has developed a process for obtaining bimaterial parts by casting an aluminum alloy around an insert coated with a metal film, characterized in that the oxide layer of the insert is removed by treatment under vacuum, and then the insert is coated with a titanium based film by physical vapor deposition (PVD), and the coated insert is placed in a mold which is filled with the casting alloy.

Thus, the invention includes three steps.

The first step includes initially removing the oxide layer which is still present at the surface of the insert by a treatment in a chamber under vacuum in order to allow proper adherence to the film with which it is then to be coated. Note the difference from the prior art where the oxide layer was removed:

1) by acid or basic washing by means of chemical products which are noxious or corrosive to varying degrees or which are harmful to the environment; or
2) by washing with the casting metal in molten state which involves the presence of oxidized particles in the metal which are detrimental to the cleanliness of the resulting bimaterial parts.

The insert used is of the form of a mass of any geometric shape, either of an aluminum alloy, of an aluminum alloy reinforced by a skeleton of refractory material, preferably formed by alumina fibers, or of a ferrous or copper product.

The second step includes coating the insert with a titanium based film.

This film is deposited using a deposition technique in the vapor phase at reduced pressure, and can be obtained in the chamber where the oxide layer is removed which is advantageous in that reoxidation is completely avoided, and a layer of pure metal is kept at the surface of the insert.

The film is formed either of pure titanium or of titanium alloy, preferably that which is known as TA6V and the composition of which by weight is aluminum 6%, vanadium 4%, remainder titanium and usual impurities. to be trapped, and a perfect bond therebetween to be produced. In fact, due to the particular properties of titanium, trapping is known to be involved, since the oxygen does not form with the titanium an oxide which could present an obstacle to the bond, but rather a solid solution in such a manner that the bond with the aluminum remains.

Moreover, titanium and its alloys are not very oxidizable at ambient temperature, and this permits such coated inserts to be stored without any risk of reoxidation, and gives more freedom to the process as far as use of protection means for the inserts and the length of time allowed for their use are concerned.

The titanium thus deposited adheres very well, and this allows the coated inserts to be handled without any special precautions being taken.

The third step includes placing the coated insert in a mold which is filled with the casting alloy. The mold can be sand or metal, and the casting operation can be carried out using various techniques such as lost wax, casting by gravity or at low pressure, squeeze-casting or pressure-casting.

As far as the casting alloy is concerned, despite the fact that any aluminum alloy is suitable, casting alloys are preferably which satisfy the following French standards (or corresponding U.S. Aluminium Association Standards in parenthesis): A-S5U3 and A-S7U3 (319), A-S9U3 (380), A-S7GO.3 (A356), A-S7GO.6 (A357), A-U5GT (A204 and A206), A-U5GT with silver (A201).

The insert-casting metal can be of two types:

1) when the titanium layer at the surface is thin, that is to say in the order of one micrometer, the bond is alternately a metallurgical bond directly between the casting alloy and the insert when the titanium layer has been broken, and a double (insert-/titanium) and (titanium/casting) alloy bond;
2) when the titanium layer is thick, that is to say above 3 micrometers, the bond is mainly in the form of a double (insert/titanium) and (titanium/-casting alloy) coupling.

The first type is applicable when the insert is aluminum based, since there is then no disadvantage in contacting the two metals, and the thickness of the film can be between 0.5 and 3 micrometers.

The second type is used with aluminum based inserts and copper or iron alloy inserts, since in the case of copper it is necessary to prevent the formation of a AlCu eutectic at low melting point which can give rise to incipient melting effects, and in the case of iron that of fragile AlFe intermetallic eutectics.

In this latter case, it is possible to make a double vapor deposition: a first layer of an element forming an effective barrier to diffusion, and then a second layer which adheres to the first and which is formed by titanium having the aim to form the bond with the casting aluminum, and preferably having a thickness of between 2 and 10 micrometers with an optimum thickness between 3 and 8 micrometers.

This process is also advantageous compared with the prior art in that it does not necessitate partial re-melting of the insert due to the affinity of the titanium for the oxide present at the surface of the liquid metal surface, and can thus be used under relatively lower temperature conditions.

BRIEF DESCRIPTION OF THE DRAWINGS:

The invention is illustrated in the accompanying FIGS. 1 to 5 which show micrographs of the insert-casting alloy bond.

In the above figures, a continuous bond is noted between the insert and the casting alloy.

DESCRIPTION OF THE PREFERRED EMBODIMENT

The invention will be better understood with the aid of the following examples:

EXAMPLE 1

An aluminum alloy insert is used, type 6061 of the Aluminium Association, the insert being coated by physical vapor deposition (P.V.D.) with a TA6V film, and around which an aluminum alloy is cast which contains, by weight, 6% silicon and 3% copper.

EXAMPLE 1.1

Figure 1:
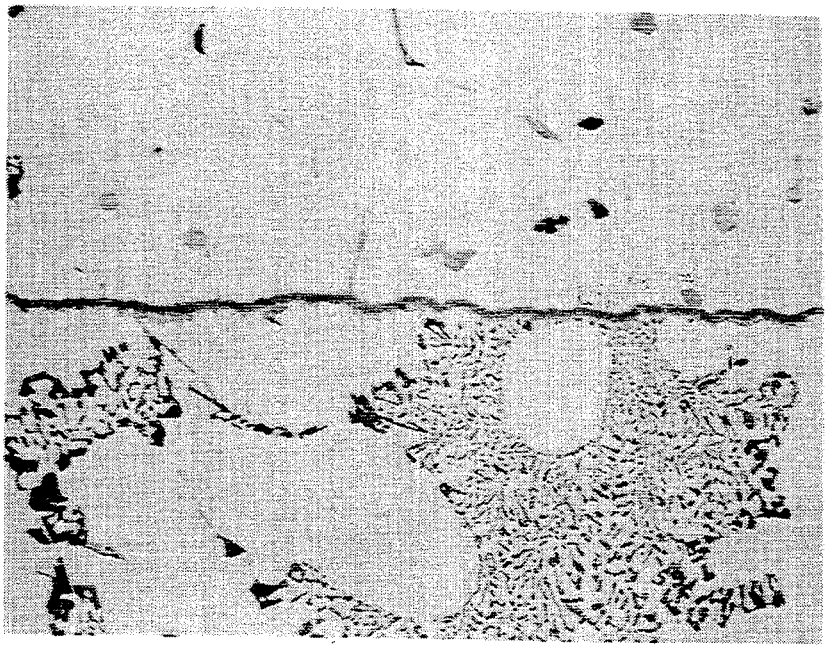
FIG. 1 shows to a scale of 400× the bond between (top) an aluminum alloy insert of the type 6061 according to the Aluminium Association Standards and between an aluminum casting alloy, type 319 by the use of a TA6V film of 1 micrometer in thickness (Example 1.1)

In a first test, as shown in FIG. 1, a film, thickness 1 micrometer was deposited, and a mechanical resistance was measured at the insert-casting alloy interface of 90 MPa.

EXAMPLE 1.2

Figure 2:
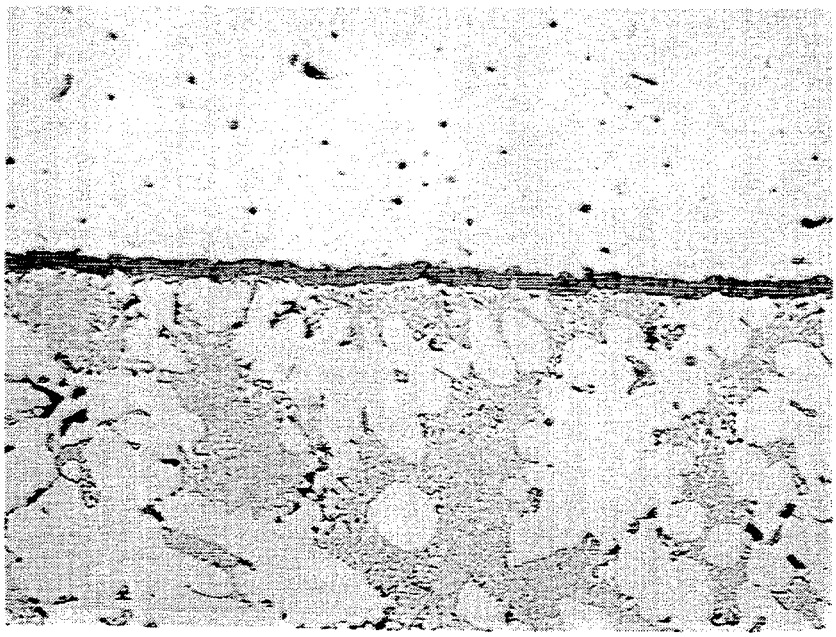
FIG. 2 shows to a scale of 200× the same bond using a TA6V film, thickness 8 micrometers (Example 1.2)

In a second test, as shown in FIG. 2, a film of thickness 8 micrometers was deposited, and a resistance of 105 MPa was measured.

EXAMPLE 2

An aluminum alloy insert, type 6061, was used, containing 20% by volume alumina fibers, and a casting alloy of the same composition as that in Example 1.

EXAMPLE 2.1

Figure 3:
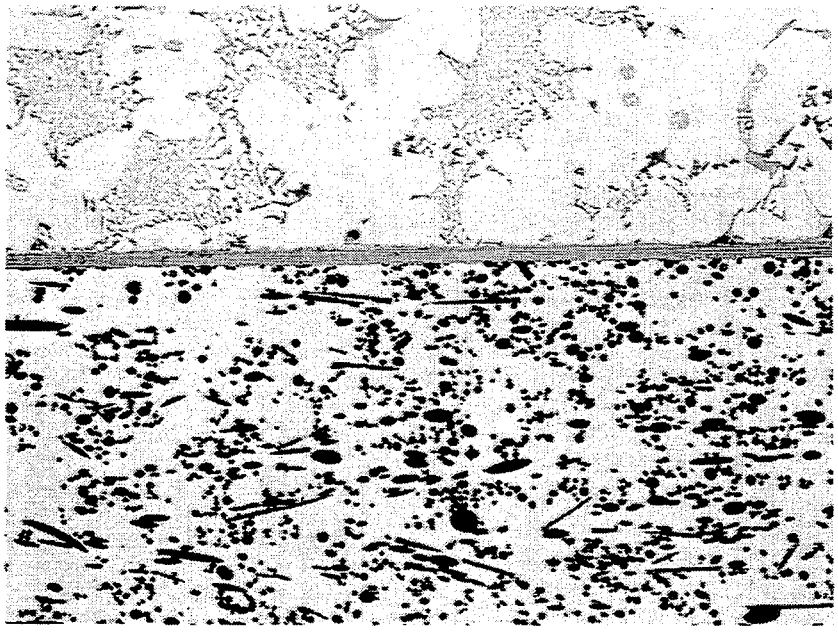
FIG. 3 shows to a scale of 200× the bond between (bottom) a 6061 insert reinforced with alumina fibers and a 319 casting alloy by the use of a TA6V film, thickness 3 micrometer (Example 2.1)

In a first test, as shown in FIG. 3, a TA6V film, thickness 1 micrometer, was deposited using the P.V.D. technique, and a traction resistance at the interface was measured of 120 MPa,

EXAMPLE 2.2

Figure 4:
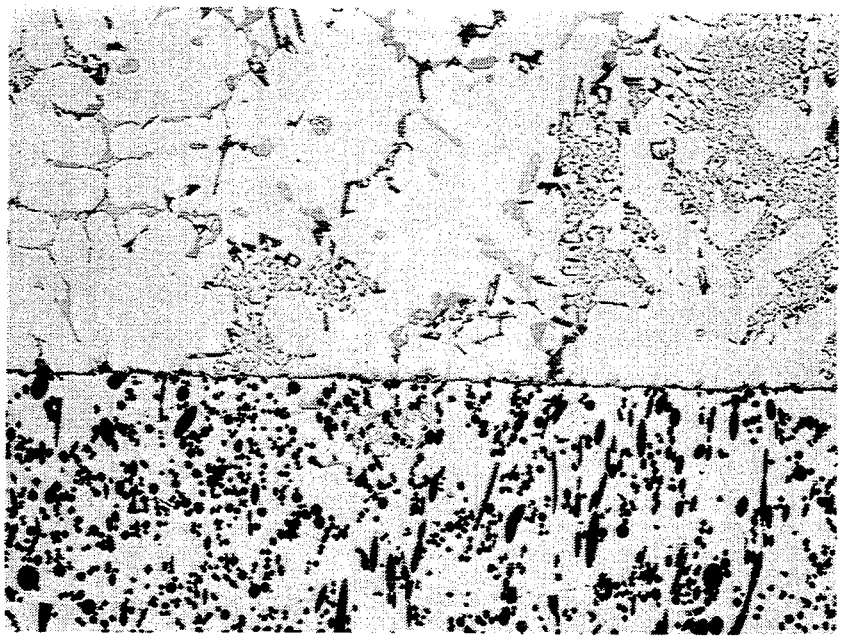
FIG. 4 shows to a scale of 200× the bond between an insert and a casting alloy of the same kind as above using a pure titanium film, thickness 1 micrometer (Example 2.2)

In a second test, as shown in FIG. 4, the same technique was used to deposit a pure titanium film, thickness 1 micrometer, and a resistance of 135 MPa was measured.

EXAMPLE 3

Figure 5:
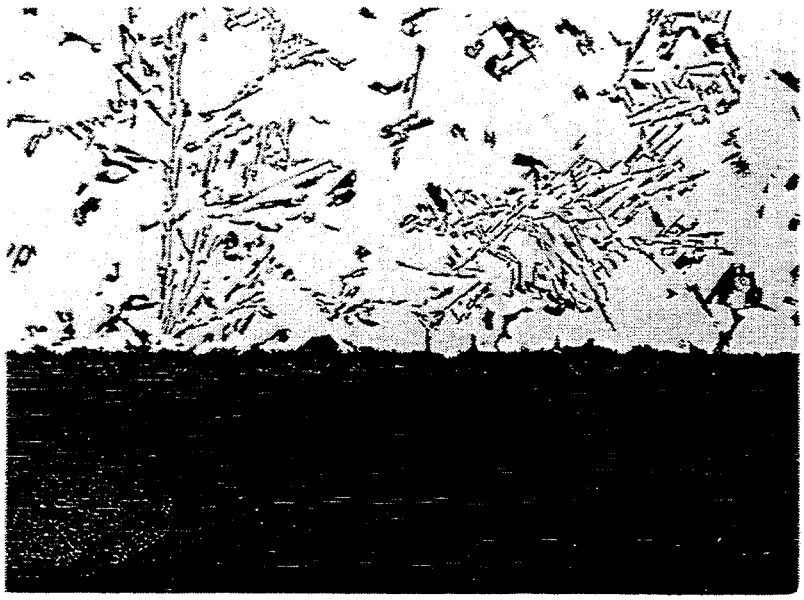
FIG. 5 shows to a scale of 200× the bond between a copper insert (bottom) and a 380 casting alloy using a titanium film, thickness 1 micrometer (Example3).

A copper insert was used which was coated with a titanium film, thickness 5 micrometers, around which an aluminum alloy was cast, containing, by weight, 9% silicon and 3% copper. The casting is shown in FIG. 5.

The invention is used, for example, in the manufacture of automobile parts such as engine cylinder heads and for the insertion of local reinforcements and pipes in aeronautical parts.

What is claimed is:

1. A process for obtaining bimaterial parts comprising removing an oxide layer from a metal insert by a vacuum treatment, coating the resulting insert with a titanium based film by physical vapor deposition, placing the coated insert in a mold, and casting an aluminum alloy around the coated insert.

2. A process according to claim 1, wherein the insert comprises an aluminum alloy.

3. A process according to claim 1, wherein the insert comprises an aluminum alloy reinforced with a skeleton of refractory material.

4. A process according to claim 1, wherein the insert comprises a Ferrous product.

5. A process according to claim 1, wherein the insert comprises of a copper product.

6. A process according to claim 1, wherein the film is pure titanium or a titanium alloy.

7. A process according to claim 6, wherein the titanium alloy is TA6V.

8. A process according to claim 1, wherein the aluminum alloy cast around the coated insert is selected from the group consisting of A-S5U3, A-S7U3, and A-S9U3.

9. A process according to claim 1, wherein the aluminum alloy cast around the coated insert is selected from the group consisting of A-S7GO.3 and A-S7GO.6.

10. A process according to claim 1, wherein the aluminum alloy is selected from the group consisting of A-U5GT and A-U5GT with silver.

11. A process according to claim 1, wherein the film is of a thickness between 0.5 and 3 micrometers.

12. A process according to claim 1, wherein the film is of a thickness between 2 and 10 micrometers.

13. A process according to claim 12, wherein the film is of a thickness between 3 and 8 micrometers.

* * * * *